US007056127B2

(12) United States Patent
Suzuki et al.

(10) Patent No.: US 7,056,127 B2
(45) Date of Patent: Jun. 6, 2006

(54) AUDIO PLUG

(75) Inventors: Jun Suzuki, Tokyo (JP); Shigeo Suzuki, Tokyo (JP)

(73) Assignee: Jamco Corporation, Tokyo (JP)

( * ) Notice: Subject to any disclaimer, the term of this patent is extended or adjusted under 35 U.S.C. 154(b) by 0 days.

(21) Appl. No.: 11/079,140

(22) Filed: Mar. 15, 2005

(65) Prior Publication Data

US 2005/0208783 A1 Sep. 22, 2005

(30) Foreign Application Priority Data

Mar. 17, 2004 (JP) ..... 2004-076115

(51) Int. Cl.
*H01R 11/30* (2006.01)

(52) U.S. Cl. ..... 439/39; 439/22; 439/923

(58) Field of Classification Search ..... 439/38, 439/39, 21, 22, 923, 180, 40
See application file for complete search history.

(56) References Cited

U.S. PATENT DOCUMENTS

| | | | | |
|---|---|---|---|---|
| 3,363,214 | A | 1/1968 | Wright | |
| 3,808,577 | A * | 4/1974 | Mathauser | 439/39 |
| 3,810,258 | A * | 5/1974 | Mathauser | 439/39 |
| 3,816,679 | A * | 6/1974 | Hotchkiss | 200/51.09 |
| 3,995,209 | A * | 11/1976 | Weston | 323/355 |
| 4,025,964 | A * | 5/1977 | Owens | 623/11.11 |
| 4,874,316 | A * | 10/1989 | Kamon et al. | 439/39 |
| 5,154,509 | A * | 10/1992 | Wulfman et al. | 362/648 |
| 6,267,602 | B1 * | 7/2001 | Mendelson et al. | 439/39 |
| 6,910,911 | B1 * | 6/2005 | Mellott et al. | 439/358 |
| 2002/0016088 | A1 | 2/2002 | Mendelson et al. | |

FOREIGN PATENT DOCUMENTS

| | | |
|---|---|---|
| DE | 200 09 514 U1 | 11/2000 |
| DE | 101 61 709 A1 | 6/2003 |
| JP | 5-54932 | 3/1993 |
| JP | 5-205811 | 8/1993 |
| JP | 09120873 | 5/1997 |
| JP | 09-204966 | 8/1997 |
| JP | 2570950 | 2/1998 |
| JP | 2001-128277 | 5/2001 |
| JP | 2002-56929 | 2/2002 |

* cited by examiner

*Primary Examiner*—Hien Vu
(74) *Attorney, Agent, or Firm*—Westerman, Hattori, Daniels & Adrian, LLP

(57) ABSTRACT

The invention provides an audio plug capable of preventing excessive stress from being applied to a plug by enabling a plug body to be detached from a plug-in portion equipped with a channel plug, thus preventing damage and deterioration of function of the plug or a connecting portion between a cable and the plug. An audio plug 1 is equipped with a plug body 2 connected to a cable 3 leading to a headset, and an adapter 20 having channel plugs 30 and 31 that can be plugged into a jack 73, capable of transmitting audio signals from the jack 73 to the plug body 2 when attached. Since the adapter 20 is detachably attached to the plug body 2 by magnetic force, when a force greater than the magnetic force is applied from the cable 3, the plug body 2 is detached from the adapter 20 leaving the adapter 20 plugged into the jack 73, thus preventing poor contact or disconnection caused by excessive force applied to a connecting portion 5 of the cable 3.

3 Claims, 4 Drawing Sheets

AUDIO PLUG

The present application is based on and claims priority of Japanese patent application No. 2004-076115 filed on Mar. 17, 2004, the entire contents of which are hereby incorporated by reference.

BACKGROUND OF THE INVENTION

1. Field of the Invention

The present invention relates to an audio plug used for utilizing an audio equipment equipped on a vehicle or the like by plugging into a jack.

2. Description of the Related Art

Heretofore, in a vehicle such as an aircraft, a headset is used to listen to music or audio of a movie, wherein an earphone or a headphone is worn on the ears or head of a user, and a plug disposed on an end of a cable extending from a speaker portion of the earphone or headphone is plugged into a jack disposed on or around a passenger seat. FIG. 4 shows one example of a prior-art two plug-type audio plug included in a headset. FIG. 4(*a*) is a plan view of the two plug-type audio plug, and FIG. 4(*b*) is a front view thereof. An audio plug 80 illustrated in FIG. 4 has a flexible cable 83 connected to an end of a plug body 82 having high rigidity via a connecting portion 85 that takes the form of a protection bushing. On the plug body 82, two channel plugs for stereo, that are, a mutually parallel left channel plug 86 and a right channel plug 87, are perpendicularly protruded from the plug body 82.

FIG. 5 shows one example of a prior-art single plug-type audio plug. FIG. 5(*a*) is a plan view of the single plug-type audio plug, and FIG. 5(*b*) is a front view thereof. Same reference numbers are provided to the components of audio plug 90 shown in FIG. 5 that are equivalent to the components of FIG. 4, and explanations thereof are omitted. In a single channel plug 91, the base-side contact is a left channel contact portion 92, and the distal end-side contact in the axial direction of the-plug is a right channel contact portion 93, wherein the two channel contact portions 92 and 93 are separated by insulating collars 94 and 95.

The headset for a vehicle mentioned above is suitable for listening to music and audio programs without causing inconvenience to the other passengers, but there sometimes occur problems in which one of the channels cannot be heard or a noise is mixed in. The main cause of these problems is considered to be the poor contact or disconnection occurring at the contact portion between the plug body having high rigidity and the flexible cable. Such malfunction is mostly caused by excessive force being applied from the cable to the plug still plugged into to the jack, such as when a passenger wearing the headset on his/her head stands up from the seat with the plug on the cable still plugged into the jack, or when a baggage or the like loads a large force on the cable. That is, since the plug connected to the jack is structured so that the plug will not be removed from the jack unless it is pulled out in an appropriate fashion, an attempt to force the plug to be removed from the jack causes excessive stress to be applied to the connection from the cable to the plug, which is assumed to be the cause of poor contact and disconnection.

A plug, a headphone and a support method for the headphone are proposed (Japanese Patent Application Laid-Open Publication No. 2001-128277 (columns 0016 through 0018 and FIG. 3), hereinafter referred to as patent document 1), in which a headphone is constituted of two receiver portions, a belt connecting the receiver portions, a cable connected to both receiver portions, and a plug disposed on the end of the cable that can be inserted to a jack, wherein a drum with a prescribed width is provided at a middle portion of the plug in the longitudinal direction, and the belt can be hung from the drum with the plug plugged into the jack so as to support the headphone using the plug.

When handling the headset, there is a fairly small possibility of poor contact or disconnection of the plug occurring as long as the passenger pays sufficient attention to the plug, but if the passenger is enjoying the music, he/she may not be conscious that the plug of the headset is plugged into the jack, and it is inevitable that the sudden move of the passenger wearing the headset, such as significant change of head position or standing from the seat, causes stress to be applied to the connection between the cable and plug body. There is a need to apply pulling force from an appropriate direction to unplug the channel plug from the jack, but in most cases where excessive force is applied on the plug from the cable, the force is not applied in the appropriate unplugging direction.

In the field of load appliances such as an electric hot water pot, a magnet plug is used as the plug for supplying electric power so that the plug is easily unplugged from the load appliance when the electric cord is pulled. A magnet plug is proposed (Japanese Patent Application Laid-Open Publication No. 05-054932, hereinafter referred to as patent document 2) in which the connection pin is prevented from being stuck when the plug body rotates while receiving pulling force from the electric cord, by defining the inner diameter of the pin insertion hole formed to the plug body. Another proposal (Japanese Patent Application Laid-Open Publication No. 05-205811, hereinafter referred to as patent document 3) proposes selecting the type of protection bushings for connecting the electric cord to the plug body in order to correspond to cases where the pullout directions of the electric cord differ. Moreover, a proposal is made (Japanese Patent Application Laid-Open Publication No. 2002-056929, hereinafter referred to as patent document 4) in which a projection having a slanted surface is provided to an outer surface of the plug body case and having the slanted surface contact the opening end of a plug receiver at the equipment when the plug is slanted, so as to enable the plug to be easily removed from the plug receiver. Even further, there exists a proposal (Japanese Utility Model Registration No. 2570950, hereinafter referred to as patent document 5) in which a magnet plug is connected to the equipment at an inner position than the bottom outer circumference surface of the equipment body, thereby preventing the magnet plug from being removed or the connection failure from occurring by the walls surrounding the equipment.

Thus, the problem to be solved is to enable the channel plug to remain plugged to the jack while enabling only the plug body to be removed by small force from a component equipped with the channel plug, when an excessive force is caused to be applied to the plug from the cable.

SUMMARY OF THE INVENTION

The object of the present invention is to provide an audio plug capable of preventing forcible stress to be applied to the plug by enabling only the plug body to be removed from a portion equipped with a channel plug when a passenger of an aircraft using a headset moves his/her head suddenly or stands up from his/her seat without bearing in mind that the plug of the headset is inserted to the jack, thereby enabling to prevent damage of the plug or prevent malfunction of the connecting portion between the plug and cable.

In order to solve the above-mentioned problems, the audio plug according to the present invention comprises a plug body connected to a cable leading to a headset, and an adapter having a channel plug to be plugged into a jack and capable of being detachably attached by magnetic force to the plug body, the adapter capable of transmitting an audio signal between the plug body and the channel plug in an attached state.

When using this audio plug, the adapter is attached to the plug body connected to the cable leading to the headset by magnetic force, either before or after plugging in the channel plug to the jack. With the adapter attached to the plug body, audio signal can be transmitted between the plug body and the channel plug, so the audio signal sent from the jack is transmitted via the channel plug of the adapter, the plug body and the cable to the headphone or earphone. Since the channel plug is plugged into the jack and connected mechanically thereto, when the adapter must be pulled out from the jack, it is necessary to select the pull-out direction and to have a large force directly applied to the adapter. The pulling force required at that time is greater than the magnetic force. Therefore, when a large force exceeding the attraction of the magnetic force is applied via the cable to the plug, such as when a user gets up from his/her seat while wearing the headset, the plug body is detached from the adapter while leaving the adapter plugged into the jack. Therefore, the present invention can prevent excessive force from being applied to the connecting portion between the cable and the plug body.

In the present audio plug, the plug body is equipped with a projection having a first channel contact for transmitting the audio signal, and the adapter is equipped with a recess which receives the projection when the adapter is attached to the plug body, the recess having a second channel contact which can be in contact with the first channel contact when the projection is received in the recess. In order to transmit the audio signal from the jack to the plug body, the plug body and the adapter must have contact structures. As an example of the contact structures, the plug body is equipped with a projection having a protruded first channel contact and the adapter is equipped with a recess having a second channel contact corresponding to the first channel contact. When the adapter is attached to the plug body, the projection is fit to the recess, and the first channel contact is in contact with the second channel contact. It is preferable that the shape of the recess be complementary with the shape of the projection.

In the present audio plug, the plug body is equipped with two projections that are mutually separated, each having a left or a right first channel contact, respectively, for transmitting the audio signal in stereo, and the adapter is equipped with two recesses that correspond to the two projections, each recess having a left or a right second channel contact, respectively, which can be in contact with the left and right first channel contacts. The left and right channel contacts for transmitting the audio signal in stereo can be disposed on the projections that are independently and separately provided to the plug body, and on the recesses that are formed to the adapter in a corresponding manner.

In the present audio plug, the plug body is equipped with a single projection having left and right first channel contacts disposed concentrically for transmitting the audio signal in stereo, and the adapter is equipped with a single recess corresponding to the projection, the recess having left and right second channel contacts disposed concentrically and capable of being in contact with the left and right first channel contacts, respectively. The left and right channel contacts for transmitting the audio signal in stereo can be provided to the plug body and the adapter concentrically in isolated manner to a single projection and a single corresponding recess. For example, if the projection is formed as a circular cone with a pointed end and the recess is formed as a complementary circular cone-shaped dent that is dented toward the bottom, the attaching of the plug body to the adapter is facilitated, and the attaching direction thereof can be any arbitrary direction around the axis of the circular cone, so the attaching operation of the plug body to the adapter is extremely simplified.

In the present audio plug, it is possible to have a magnet disposed on one of a top end of the projection or a bottom of the recess, and to have a magnetic member disposed on the other, which is capable of magnetically attracting the magnet. In the state where the adapter is attached to the plug body, the magnet disposed on either the end of the projection or the bottom of the recess is magnetically attracted to the magnetic member of the opposing member, and the attachment of the adapter to the plug body is maintained in the range of the magnetic force.

In the present audio plug, it is possible to have a magnet disposed on one of annular walls of the plug body or the adapter which are in confronting relationship in the attached state, and to have a magnetic member disposed on the other annular wall, which is capable of magnetically attracting the magnet. In the state where the adapter is attached to the plug body, the magnet disposed on either one of the mutually confronting annular walls is attracted to the magnetic member disposed on the other annular wall, and the attachment of the adapter to the plug body is maintained in the range of the magnetic force.

The present audio plug is capable of being applied by plugging into a jack provided on an audio equipment equipped on a vehicle such as an aircraft, a railway car, a ship or a camping car. In a vehicle such as an aircraft, a railway car, a ship or a camping car, if the audio plug is malfunctioning, the repairing operation thereof must be performed in an appropriate facility. By applying the audio plug of the present invention to the audio equipment on these vehicles, malfunction of the audio plug can be suppressed, contributing to the reduction of cost and work related to repairing and replacing of the plug.

The audio plug according to the present invention is composed as described above, so that in a vehicle such as an aircraft, if the passenger using the headset moves his/her head suddenly or stands up from his/her seat without bearing in mind that the plug of the headset is plugged into the jack, a force exceeding the holding power of the magnet operates between the plug body and adapter, by which only the plug body is removed from the portion equipped with the channel plug. Therefore, the plug is prevented from being subjected to forcible stress, by which the damage to the connecting portion between the cable and plug body of the audio plug and the malfunction thereof such as poor contact can be prevented.

DETAILED DESCRIPTION OF THE PREFERRED EMBODIMENTS

Figure 1:
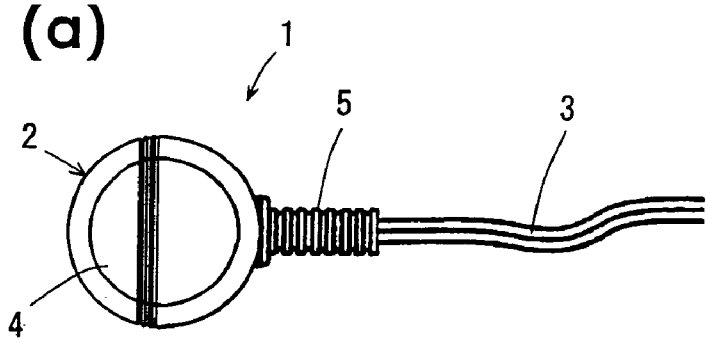
FIG. 1 is a drawing showing one embodiment of an audio plug according to the present invention.
Figure 1:
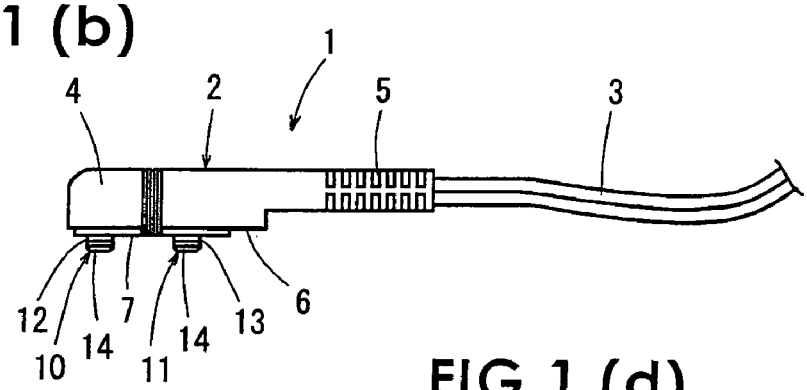
Figure 1:
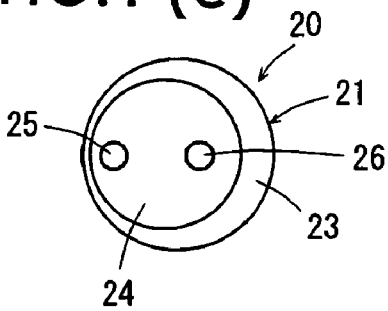
Figure 1:
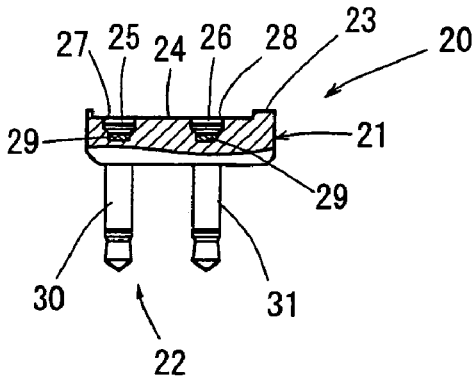
Figure 1:
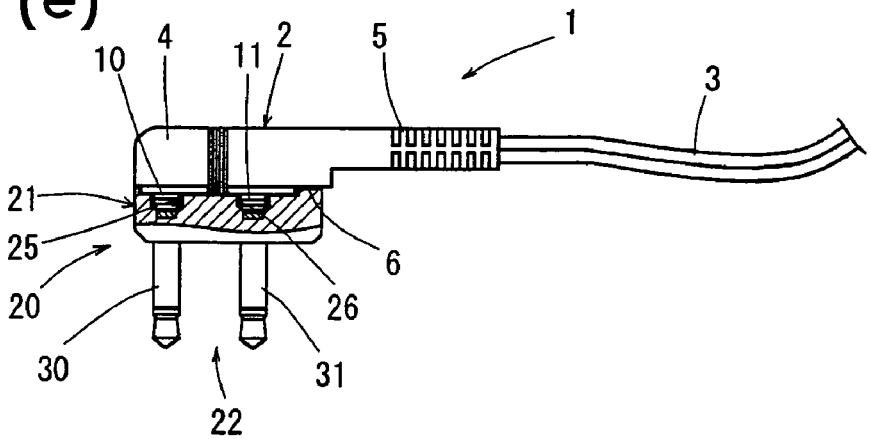

A preferred embodiment of an audio plug according to the present invention will now be described with reference to the drawings. FIG. 1 is a view showing one preferred embodiment of the audio plug according to the present invention, wherein FIG. 1(*a*) is a plan view of the audio plug, FIG. 1(*b*) is a front view of the audio plug showing the state where the adapter is removed, FIG. 1(*c*) is a plan view of the adapter, FIG. 1(*d*) is a front view of the adapter, and FIG. 1(*e*) is a front view of the audio plug with the adapter connected.

According to the embodiment shown in FIG. 1, an audio plug 1 is structured as a two plug-type plug in which the left and right channels are separated. The audio plug 1 is equipped with a plug body 2 connected to a cable 3 that extends to a headphone or an earphone (not shown), and an adapter 20 that can be attached in a detachable manner to the plug body 2. As illustrated in FIGS. 1(*a*) and 1(*b*), the plug body 2 made of synthetic resin, for example, is composed of a low cylindrical column 4 and a protection bushing 5 that extends integrally from the cylindrical column 4 and covers a connecting portion of the cable 3.

On one side wall 6 formed flatly on the plug body 2 at the side on which an adapter 20 is to be attached is formed a slightly projected flat circular seat portion 7, and on the seat portion 7 are formed projections 10 and 11 that protrude perpendicularly from the seat portion 7 at mutually separated independent positions. The projections 10 and 11 have the same height and diameter, but as mentioned later, they have a cylindrical structure with a very low height so that they can be easily detached from the adapter 20. In order to transmit the stereophonic sound signal functioning as audio signal, the projections 10 and 11 are each provided as a conductive contact point to which left and right first channel contact points 12 and 13 are capable of being connected electrically. At the ends of projections 10 and 11 are provided magnetic contact portions 14, 14 that enable the projections to be magnetically attached to and detached from an adapter 20.

As illustrated in FIGS. 1(*c*) and 1(*d*), the structure of the adapter 20 allows it to be plugged into a jack disposed on or near a seat of a passenger vehicle (refer to FIG. 3), and to be detachably attached to the plug body 2. The adapter 20 is formed of a nonconductive synthetic resin, and has an attachment portion 21 that can be detachably attached to the plug body 2, and a plug-in portion 22 that can be plugged into the jack.

The attachment portion 21 has a complementary structure with respect to the seat portion 7 and the projections 10 and 11 formed on one side wall 6 of the plug body 2. In other words, the attachment portion 21 enables the plug body 2 to be attached to the adapter 20 by having an annular flat wall 23 that contacts the one side wall 6 of the plug body 2, the annular flat wall 23 having a circular dent portion 24 allowing the seat portion 7 to be fit therein, the dent portion 24 having recesses 25 and 26 that are independently opened at positions and with sizes that correspond to the projections 10 and 11. On the recesses 25 and 26, second channel contacts 27 and 28 are disposed as conductive contacts, respectively, that can each be in contact with the left and right first channel contacts 12 and 13 so as to transmit the stereophonic sound signals as audio signals. While the adapter 20 is attached to the plug body 2, the projections 10 and 11 of the plug body 2 are each inserted to the recesses 25 and 26 of the adapter 20, and thus the first channel contacts 12 and 13 disposed on the projections 10 and 11 are each in contact with the second channel contacts 27 and 28 disposed on the recesses 25 and 26. A magnetic member 29 is disposed on the bottom of recesses 25 and 26, and with the projections 10 and 11 inserted to the recesses, it is magnetically attracted to the magnetic contact portion 13 disposed at the end of projections 10 and 11, by which the plug body 2 and the adapter 20 are magnetically held together. Incidentally, it is possible to dispose instead of the magnetic member 29 a magnetic contact portion having a polarity opposite to the magnetic surface of the magnetic contact portion 14 that can be attracted to the magnetic contact portion 14.

Figure 4:
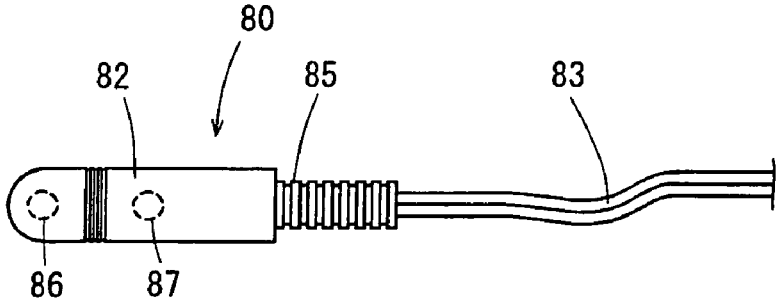
FIG. 4 is a view showing one example of a prior art audio plug.
Figure 4:
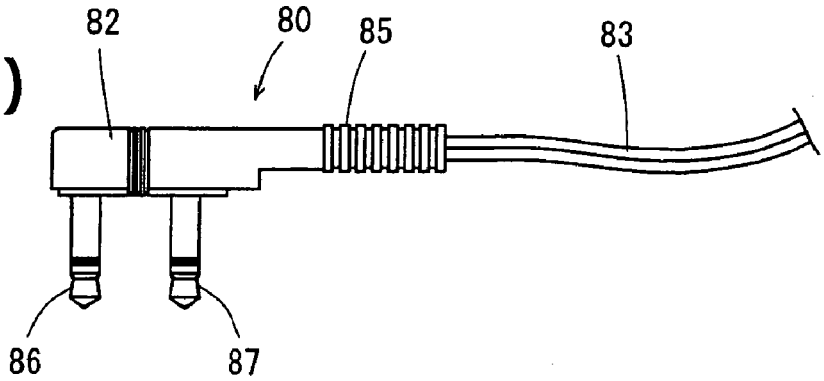

The plug-in portion 22 of the adapter 10 has the same structure as a channel plug equipped to a prior-art audio plug. That is, the plug-in portion 22 is equipped with a left channel plug 30 and a right channel plug 31 that are formed of parallel conductive metal members. Since the jack equipped to the facility on the vehicle has the same structure as that of the prior art with two plug inserting holes, the left and right channel plugs 30 and 31 have the same structure as the prior-art channel plug shown in FIG. 4.

Upon attaching the plug body 2 to the adapter 10, the projections 10 and 11 are each fit into the recesses 25 and 26, and the seat portion 7 is inserted to the dent portion 24 until the one side wall 6 is in contact with the flat wall 23. This state is shown in FIG. 1(*e*). In FIG. 1(*e*), the first channel contacts 12 and 13 shown in FIGS. 1(*c*) and 1(*d*) are in contact with the second channel contacts 27 and 28, and the magnetic contact portion 14 is magnetically attracted to the magnetic contact portion 29. According to such arrangement, a contact structure is achieved that enables the audio signals to be transmitted to the plug body 2 via the adapter 20. Since the plug body 2 is only magnetically connected to the adapter 10, when the plug body 2 is pulled from the cable 3 with a power exceeding the magnetic force, such as by the passenger standing from his/her seat while wearing the headset, the plug body 2 is detached from the adapter 20. Therefore, the contact portion between the cable 3 and plug body 2 is not exposed to excessive stress, and so the contact will not be deteriorated.

Figure 2:
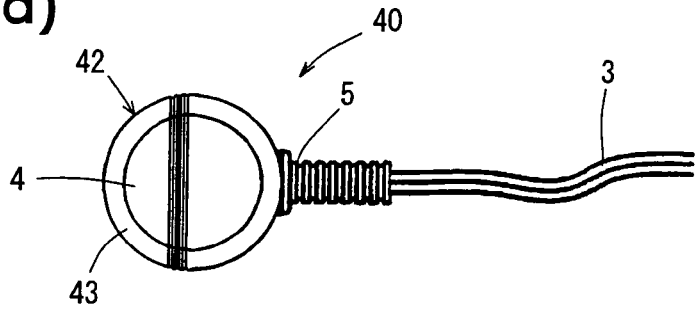
FIG. 2 is a drawing showing another embodiment of an audio plug according to the present invention.
Figure 2:
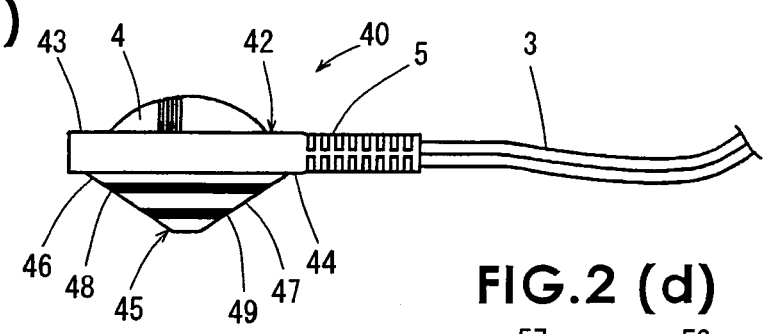
Figure 2:
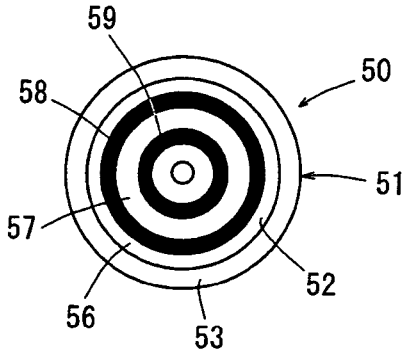
Figure 2:
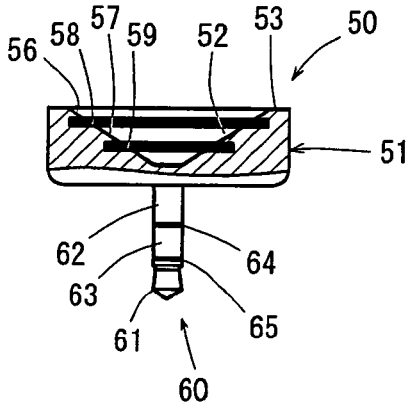
Figure 2:
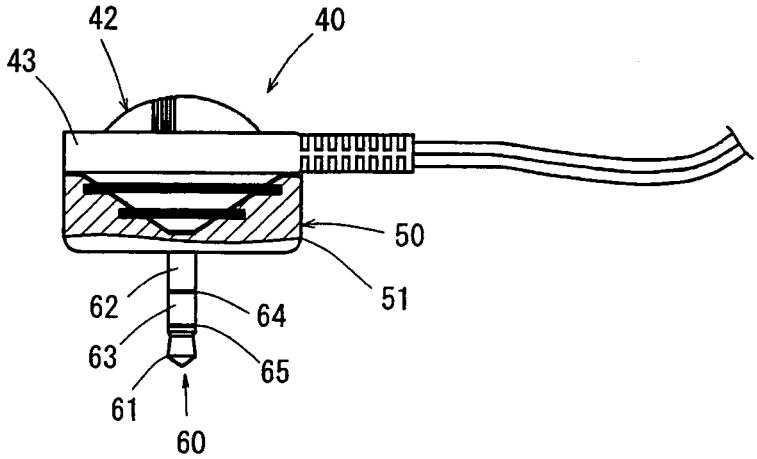

Based on FIG. 2, another embodiment of the audio plug according to the present invention will be described. FIG. 2(*a*) is a plan view showing another embodiment of the audio plug according to the present invention, FIG. 2(*b*) is a front view showing the state in which the adapter of the audio plug of 2(*a*) is removed, FIG. 2(*c*) is a plan view of the adapter, FIG. 2(*d*) is a front view of the adapter, and FIG. 2(*e*) is a front view of the audio plug showing the state in which the adapter is attached. According to an audio plug 40 shown in FIG. 2, the basic structure of the plug body 42 is substantially the same as the structure of the plug body 2 of the audio plug 1 shown in FIG. 1, so the equivalent components are denoted by the same reference numbers, and detailed explanations thereof are omitted.

The plug body 42 is equipped with an annular flange 43, and on the side of the flange to be attached to an adapter 50 is provided a single projection 45 that protrudes in the shape of a circular cone with a pointed end, leaving an annular wall 44. The projection 45 is provided with a left first channel contact 46 and a right first channel contact 47 disposed concentrically as left and right first channel contacts that enable the audio signals to be transmitted in stereo. Annular insulating collars 48 and 49 are concentrically formed in order to mutually isolate the first channel contacts 46 and 47. Further, the annular wall 44 of the flange 43 is formed of a magnet, so as to magnetically attract the attached adapter 50.

The adapter 50 is composed of a cylindrical column portion 51 into which the projection 45 can be inserted, and a plug-in portion 60 extending from the circular column 51 and capable of being plugged into the jack. On the circular column portion 51 is formed a single recess 52 in the form of a circular cone-shaped dent that is dented toward the bottom, which is complementary with the projection 45, and placed in a position corresponding to the projection 45. An annular wall 53 is formed around the dent 52, which is formed of a magnetic member onto which the annular wall 44 of the annular flange 43 formed of a magnet can be magnetically attracted. On the wall surface of the dent 52 are concentrically disposed a left second channel contact 56 and a right second channel contact 57. Insulating collars 58 and 59 are disposed to correspond to the insulating collars 48 and 49 formed on the side of the first channel contact, so as to isolate the second channel contacts 56 and 57. Since the projection 45 and recess 52 are structured in the shape of complementary circular cones, the attachment of the plug body 42 to the adapter 50 is facilitated, and at the same time, the attachment direction can be arbitrary around the axis of the circular cone, so the attachment operation of the plug body 42 to the adapter 50 is extremely easy.

Figure 5:
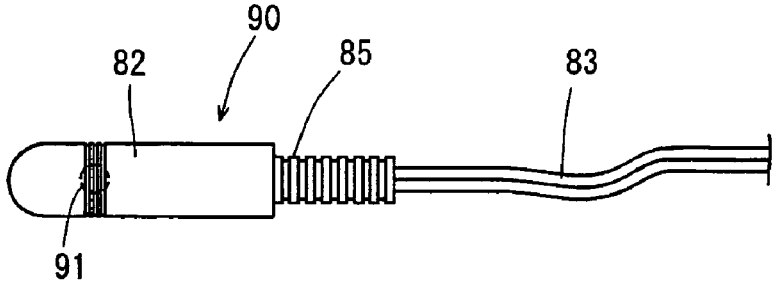
FIG. 5 is a view showing another example of a prior art audio plug.
Figure 5:
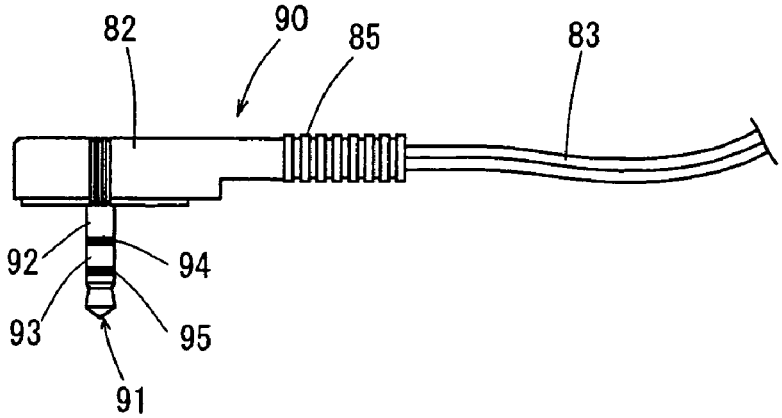

The adapter 50 is equipped with a plug-in portion 60 to be plugged into the jack. The plug-in portion 60 is formed of a channel plug 61 that is substantially the same as the prior-art single plug-type member as shown in FIG. 5. The channel plug 61 has left and right channel contacts that are separated in the axial direction by insulating collars 64 and 65, wherein the contact near the base is a left channel contact 62, and the contact near the distal end is a right channel contact 63. In the audio plug 40, it is possible to dispose a magnet on the bottom of the dent 52 of the adapter 50 and to dispose a magnetic member on the projection 45 of the plug body 42 that is capable of magnetically attracting the magnet.

According to the audio plug 40, when the adapter 50 and the plug body 42 are attached as shown in FIG. 2(*e*), the annular wall 44 on the plug body 42 and the annular wall 53 on the adapter 50 in confronting relations are magnetically attracted by the magnet and the magnetic member, by which the attached state of the adapter 50 to the plug body 42 is maintained in the range of the magnetic force. In this state, the first channel contacts 46 and 47 on the plug body 42 form a contact with the second channel contacts 56 and 57 on the adapter 50, and the insulating collars 48 and 49 on the plug body 42 come into contact with the insulating collars 58 and 59 on the adapter 50, so the stereophonic audio signals from the jack are transmitted via the adapter 50 and the plug body 42 to the cable 3. If a greater force than the magnetic force is applied from the cable 3 to the audio plug 40, the plug body 42 is detached from the adapter 50 similar to the case of the audio plug shown in FIG. 1, so the contact portion 5 will not be exposed to any excessive stress.

Figure 3:
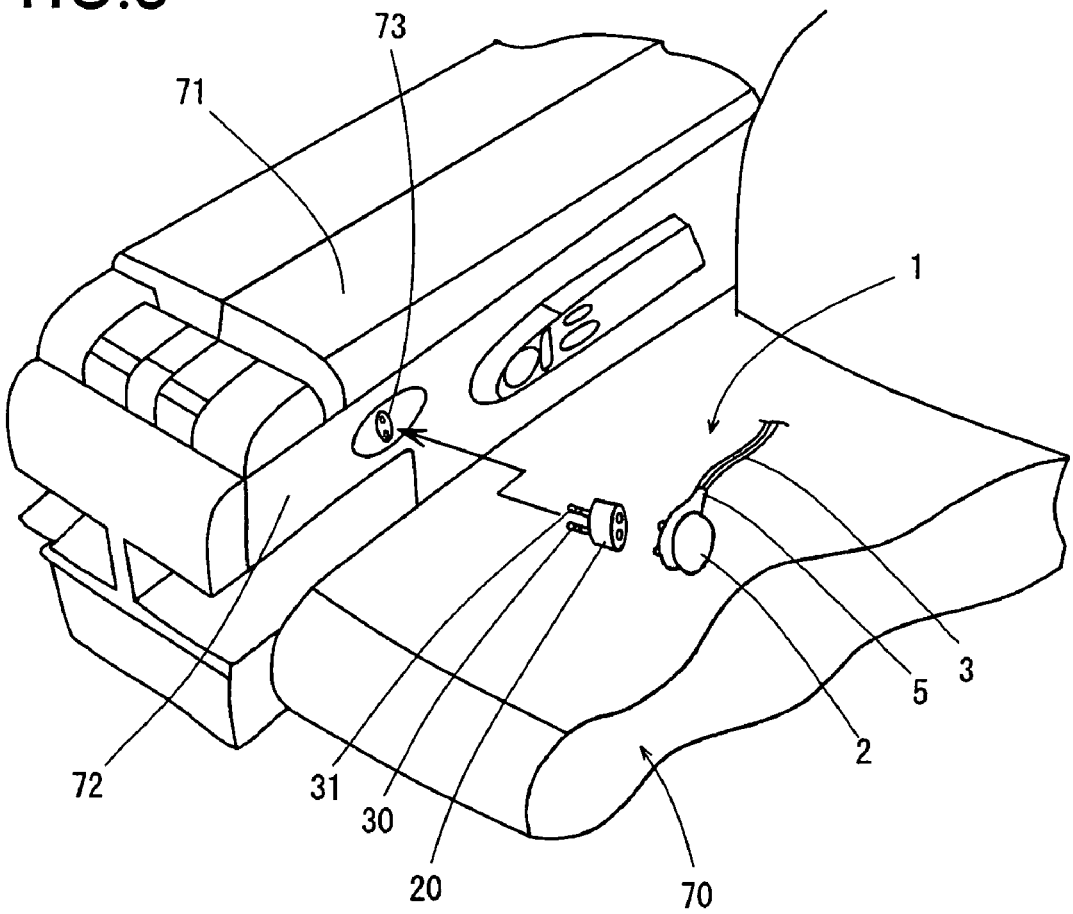
FIG. 3 is an explanatory view showing the application of the audio plug according to the present invention to a seat of an aircraft.

FIG. 3 is an explanatory view showing the state in which the audio plug according to the present invention is applied to a passenger seat on an aircraft. As illustrated in FIG. 3, a jack 73 is disposed on a side panel 72 of an armrest 71 of a seat (only a portion of which is shown) 70 to enable audio signals to be taken out. The audio plug 1 having the details shown in FIG. 1 is used, and when the audio is to be listened to using a headphone or an earphone, either the adapter 20 is plugged into the jack 73 with the plug body 2 already attached to the adapter 20, or the plug body 2 is attached to the adapter 10 with the adapter 20 already plugged into the jack 73. When a force greater than the magnetic force attaching the adapter 20 to the plug body 2 is received from the cable 3, the plug body 2 is detached from the adapter 20, leaving the adapter 20 still plugged into the jack 73. Therefore, no excessive force is applied to the connection 5 from the cable 3 to the plug body 2. Thus, the present invention enables to prevent problems such as poor contact or disconnection from occurring.

In the above embodiments, an aircraft is referred to as an example of the vehicle to which the present invention is applied, but the application of the audio plug of the present invention is not restricted thereto, and clearly, it is applicable to vehicles such as camping cars, railway cars, sailboats and the like, and to facilities which prioritize space saving, such as cabins.

What is claimed is:

1. An audio plug comprising:

a plug body connected to a cable leading to a headset; and an adapter having a channel plug to be plugged into a jack and capable of being detachably attached by magnetic force to the plug body the channel plug having insulating collars theron, the adapter capable of transmitting an audio signal between the plug body and the channel plug in an attached states, wherein the plug body is equipped with a conical projection having a first channel contact for transmitting the audio signal, and the adapter is equipped with a recess which receives the projection when the adapter is attached to the plug body, the recess having a second channel contact which can be in contact with the first channel contact when the projection is received in the recess, and further wherein the plug body is equipped with a single said projection having left and right first channel contacts disposed concentrically for transmitting the audio signal in stereo, and the adapter is equipped with a single said recess corresponding to the projection, the recess having left and right second channel contacts disposed concentrically and capable of being in contact with the left and right first channel contacts, respectively.

2. The audio plug according to claim 1 having a magnet disposed on one of annular walls of the plug body or the adapter which are in confronting relationship in the attached state, and having a magnetic member disposed on the other annular wall, which is capable of magnetically attracting the magnet.

3. The audio plug according to claim 1 capable of being applied by plugging into a jack provided on an audio equipment equipped on a vehicle such as an aircraft, a railway car, a ship or a camping car.

* * * * *